US007354287B1

(12) United States Patent
Hickam

(10) Patent No.: US 7,354,287 B1
(45) Date of Patent: Apr. 8, 2008

(54) SHORTING CONNECTOR

(75) Inventor: Chris D. Hickam, Glasford, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/590,544

(22) Filed: Oct. 31, 2006

(51) Int. Cl.
*H01R 29/00* (2006.01)

(52) U.S. Cl. ..... 439/188; 200/51.1

(58) Field of Classification Search ..... 439/188; 200/51.1
See application file for complete search history.

(56) References Cited

U.S. PATENT DOCUMENTS 3,512,043 A * 5/1970 Stange et al. ..... 361/35
4,628,818 A * 12/1986 Nilsson ..... 102/202.2
4,820,193 A * 4/1989 Noorily ..... 439/488
4,971,568 A 11/1990 Cronin
5,004,435 A * 4/1991 Jammet ..... 439/652
5,238,422 A * 8/1993 Scherer ..... 439/188
5,252,082 A * 10/1993 Hsieh et al. ..... 439/141
5,267,868 A * 12/1993 Wolff, Jr. ..... 439/95
5,352,128 A * 10/1994 Bricaud ..... 439/188
5,401,180 A * 3/1995 Muzslay ..... 439/188
5,425,649 A 6/1995 Reymond
5,518,411 A * 5/1996 Belleci ..... 439/141
5,584,713 A * 12/1996 Kato et al. ..... 439/188
5,697,501 A * 12/1997 Johansen ..... 206/719
5,763,814 A * 6/1998 Avory et al. ..... 102/202.7
5,949,160 A * 9/1999 Anderson et al. ..... 307/140
5,989,046 A * 11/1999 Togashi ..... 439/188
6,049,143 A * 4/2000 Simpson et al. ..... 307/126
6,167,291 A * 12/2000 Barajas et al. ..... 600/374
6,196,858 B1 3/2001 Matsumoto et al.
6,770,986 B2 8/2004 Nagao et al.
6,835,079 B2 12/2004 Gentry et al.
6,932,643 B2 8/2005 Bigotto
6,979,787 B2 12/2005 Davies
2003/0040228 A1* 2/2003 Finzer et al. ..... 439/752

* cited by examiner

*Primary Examiner*—Tulsidas C. Patel
*Assistant Examiner*—Vladimir Imas
(74) *Attorney, Agent, or Firm*—Richard K. C. Chang, II

(57) ABSTRACT

An electrical connector includes a housing that may form a first contact channel and a second contact channel. A first contact having a longitudinal axis may be disposed within the first contact channel, and a second contact may be disposed within the second contact channel. A shorting arm may be configured to move generally parallel to the longitudinal axis of the first contact between a first position and a second position. When the shorting arm is in the first position, the shorting arm electrically connects the first contact with the second contact, and when the shorting arm is in the second position, the shorting arm is separated from the first and second contacts.

20 Claims, 2 Drawing Sheets

SHORTING CONNECTOR

STATEMENT OF GOVERNMENT INTEREST

The United States Government has certain rights in the present patent application, and any patent that may issue thereon, under DOE Contract No. FC26-04NT42258.

TECHNICAL FIELD

This invention relates generally to electrical connectors having an integral shorting system.

BACKGROUND

"Shorting connectors" are electrical connectors that include shorting systems and may be used where it is necessary to short a circuit upon disconnection from another circuit. For example, shorting connectors may be used in current monitoring circuits that include current transformers or in an airbag activation circuit. However, many existing shorting connectors may be limited to low voltage applications, while others are at risk to inadvertently short at the wrong time during connection or disconnection of the electrical circuits causing damage to the electrical system.

One application where shorting at the wrong time may damage an electrical system is in the connection of a component to a power supply. If the contacts of the shorting connector are still electrically connected to the power supply when the shorting system is activated, the power supply will be shorted. Shorting the power supply may damage the power supply requiring repair and potential replacement of the power supply.

This risk of shorting at the wrong time may be compounded by the difficulty in manufacturing the shorting connector. For example, U.S. Pat. No. 4,971,568 or the "'568 patent" discloses an electrical connector assembly with attachment for automatically shorting select conductors upon disconnection of a connector. The shorting system of the '568 patent uses elongated arms extending from a base portion to contact a pin of the connector when it is disconnected from a receptacle.

However, the shorting system of the '568 patent may have to be manufactured to relatively narrow tolerances because if the elongated arms are too short, the shorting system will prematurely activate. Conversely, if the elongated arms are too long, the elongated arms may interfere with the connection of the connector with the receptacle and may extend from the connection. Additionally, because the base and elongated arms are disposed near the pins of the shorting connector of the '568 patent, the shorting connector of the '568 patent may be inadvertently shorted by minor condensation or water preventing its use outside of a controlled environment. Furthermore, if the shorting connector of the '568 patent is removed at an angle, the pins may be shorted prior to electrical separation from the receptacle, which as discussed above may damage a connected power supply or the component.

The present invention is directed to overcome one or more of the problems as set forth above.

SUMMARY OF THE INVENTION

In one example of the present invention, an electrical connector having a shorting system is provided. The electrical connector may include a housing, a first contact extending from the housing and having an end disposed remotely from the housing, and a second contact extending from the housing and having an end disposed remotely from the housing. A shorting arm may be configured to move generally parallel to the first contact between a first position and a second position. When the shorting arm is in the first position, the shorting arm electrically connects the first contact with the second contact. When the shorting arm is in the second position, the shorting arm is separated from the first and second contacts.

Alternatively, the electrical connector may include a housing forming a first contact channel and a second contact channel. A first contact having a length may be disposed within the first contact channel, and a second contact may be disposed within the second contact channel. A shorting arm may be configured to move generally parallel to the length of the first contact between a first position and a second position.

In addition, the present invention includes a method of disconnecting an electrical connector from a mating connector having a first mating contact and a second mating contact. The method may include the steps of disconnecting a first contact of the electrical connector from the first mating contact, disconnecting a second contact of the electrical connector from the second mating contact, moving a shorting arm of the electrical connector generally parallel to the first contact of the electrical connector from a second position to a first position after the first and second contacts of the electrical connector have been disconnected from the first and second mating contacts, and completely separating the electrical connector from the mating connector.

DETAILED DESCRIPTION

Figure 1A:
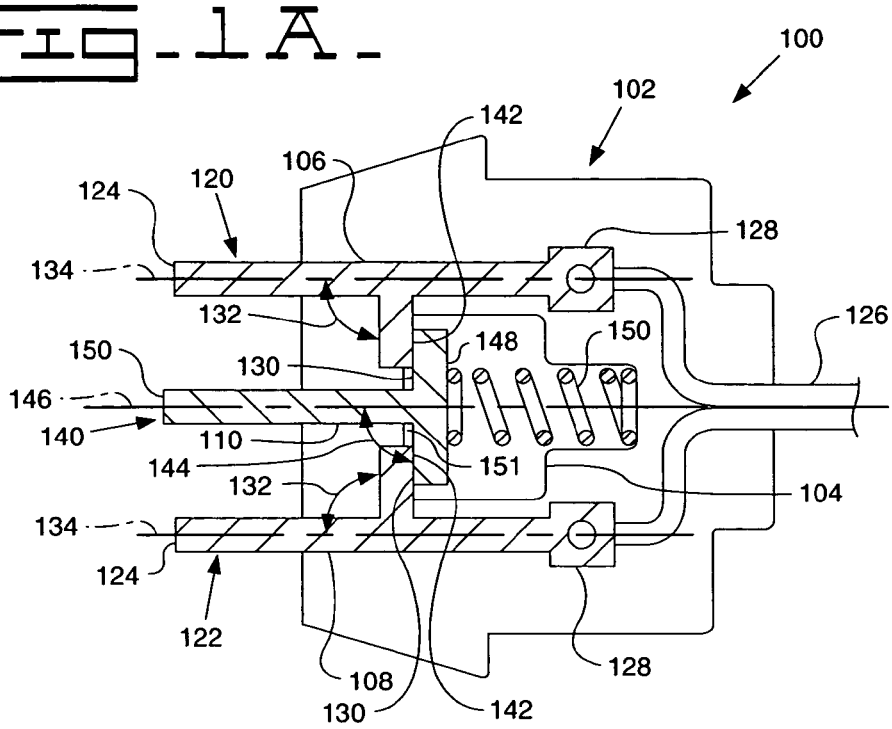
FIG. 1A is a cross sectional view of an electrical connector having a shorting arm in a first position.

Referring to FIG. 1A, a cross sectional view illustrates an electrical connector 100 having a housing 102. The housing 102 may include a shorting chamber 104, a first contact channel 106, a second contact channel 108, and a shorting channel 110. As shown, the shorting chamber 104 may connect with the first contact channel 106, the second contact channel 108, and the shorting channel 110.

The housing 102 may be made of plastic or composite that has been injection molded. Of course, the housing 102 may also be made of metal or ceramic that has been formed through various manufacturing processes such as molding, stamping, machining, and other processes known in the art.

In addition to the housing 102, the electrical connector 100 may include a first contact 120 and a second contact 122 that may be respectively disposed within the first contact channel 106 and the second contact channel 108 of the housing 102. Of course, the electrical connector 100 may include additional contacts (not shown).

In some configurations, the first and second contacts 120, 122 may be disposed in the respective first and second contact channels 106, 108 so that the first and second contacts 120, 122 extend from the housing 102 and each have an end 124 disposed remotely from the housing 102. The first and second contacts 120, 122 may be connected to an electrical conductor 126, such as a wire (as shown) or a trace on a printed circuit board, near another end 128 of the first and second contacts 120, 122. The first and second contacts 120, 122 may also each include a shorting surface 130 that may be disposed at an angle 132 to a longitudinal axis 134 of the first or second contacts 120, 122 respectively.

A shorting arm 140 may be disposed to move within the shorting channel 110. In some configurations, the shorting arm 140 may move generally parallel to the longitudinal axis 134 of the first contact 120. Additionally, the shorting arm 140 may move linearly between the first and second positions. The shorting arm 140 may include a shorting surface 142 that may be disposed at an angle 144 to a longitudinal axis 146 of the shorting arm 140.

Additionally, the shorting arm 140 may include an abutment surface 148 for abutting a spring 150 disposed within the shorting chamber 104 that biases the shorting arm 140 toward the first position.

As shown in FIG. 1A, when the shorting arm 140 is in the first position, the shorting surface 142 of the shorting arm 140 abuts the shorting surfaces 130 of the first and second contacts 120, 122. More specifically, when the shorting arm 140 in the first position, the shorting arm 140 electrically connects the first contact 120 with the second contact 122 by placing the shorting surface 142 of the shorting arm 140 in contact with the shorting surfaces 130 of the first and second contacts 120, 122. Consequently, any difference in voltage between the first and second contacts 120, 122 is removed.

To facilitate contact between the shorting surface 142 of the shorting arm 140 and the shorting surfaces 130 of the first and second contacts 120, 122, the shorting surfaces 130 of the first and second contacts 120, 122 may be disposed away from the structure of the housing 102. In other words, the shorting surfaces 130 of the first and second contacts 120, 122 may be spaced from the structure of the housing 102 by a gap 151.

Further, the shorting arm 140 and or the first and second contacts 120, 122 may be designed to flex when in the first position to encourage good electrical contact between the shorting arm 140 and both the first and second contacts 120, 122.

In alternative configurations, the shorting arm 140 may be disposed to electrically connect the first and second contacts 120, 122 with additional contacts (not shown) when in the first position.

Figure 1B:
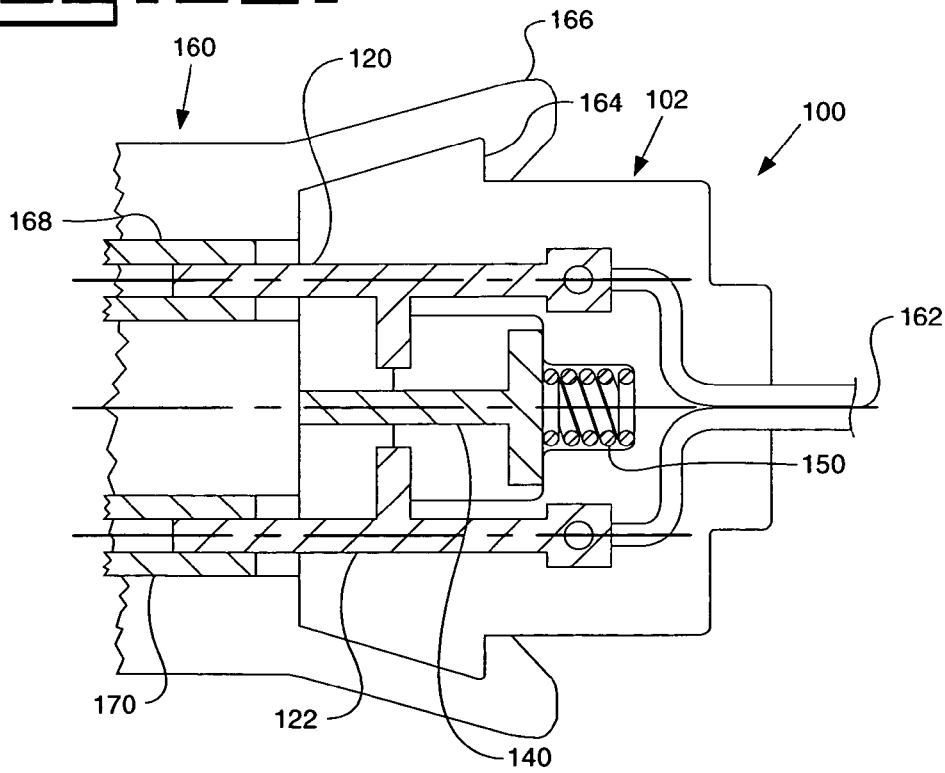
FIG. 1B is a cross sectional view of the electrical connector coupled to a mating connector so that the shorting arm is disposed in a second position.

When the shorting arm 140 is in the first position, an end 152 of the shorting arm 140 may extend past the ends 124 of the first and second contacts 120, 122 from the housing 102. This permits the shorting arm 140 to be engaged before the first and second contacts 120, 122 by a mating connector 160 as shown in FIG. 1B, which moves the shorting arm 140 out of the first position and disconnects the first contact 120 from the second contact 122. Consequently, the safety of the electrical connector 100 is enhanced by preventing the first and second contacts 120, 122 from being in electrical communication when the electrical connector 100 is coupled to the mating connector 160.

Referring to FIG. 1B, the electrical connector 100 is coupled to the mating connector 160 and consequently, the shorting arm 140 may be disposed in the second position by moving along a longitudinal axis 162 of the housing 102. In the second position, the shorting arm 140 is separated from the first and second contacts 120, 122, which electrically disconnects the first contact 120 from the second contact 122.

Additionally, the spring 150 may be compressed. To prevent the force of the spring 150 from decoupling the electrical connector 100 from the mating connector 160, the housing 102 of the electrical connector 100 may include retention features 164 that may engage reciprocal retention features 166 of the mating connector 160. The retention features 164 and the reciprocal retention features 166 may be a detent, hole, hook, extension, latch, or any other structure that may be used to secure the coupling of the electrical connector 100 with the mating connector 160.

Alternatively, the force of the compressed spring 150 may be countered by a tight fit between the first and second contacts 120, 122 of the electrical connector 100 and a first mating contact 168 and a second mating contact 170 of the mating connector 160.

Figure 1C:
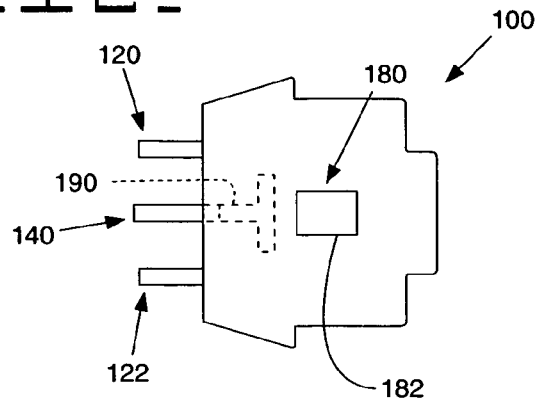
FIG. 1C is plan view of an upper surface of the electrical connector.

Referring to FIG. 1C, a plan view illustrates a visual indicator 180 that may be used to indicate the position of the shorting arm 140, shown in broken lines, within the electrical connector 100. For example, the visual indicator 180 may be a window 182 disposed in the housing 102 of the electrical connector 100. The shorting arm 140 may have an indicator portion 190 that may be seen through the window 182 when the shorting arm 140 is disconnected from the first and second contacts 120, 122 of the electrical connector 100.

The visual indicator 180 may be used to ensure that the electrical connector 100 is operating properly. Consequently, the safety of the electrical connector 100 may be improved.

Figure 2:
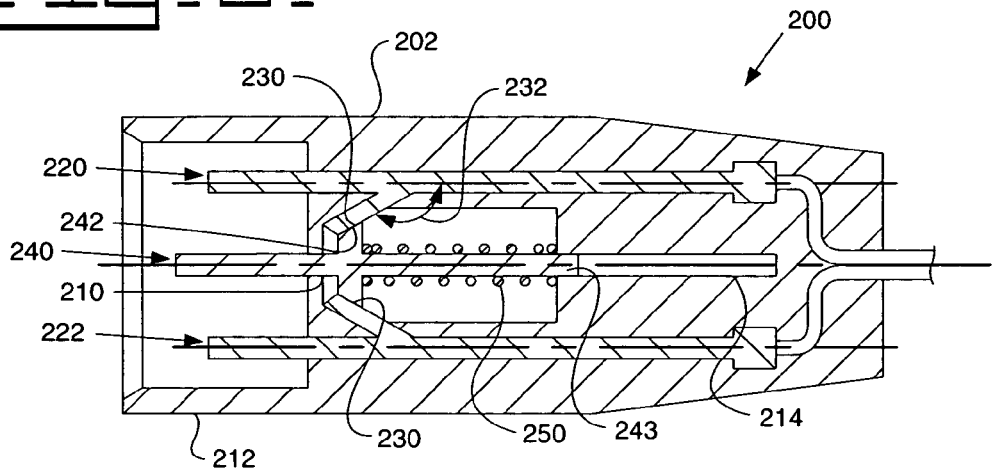
FIG. 2 is a cross sectional view of another electrical connector.

Referring to FIG. 2, another configuration of an electrical connector 200 is illustrated. In this configuration, the housing 202 may include a shroud 212 and a guide channel 214. The shroud 212 may protect a first contact 220 and a second contact 222 from inadvertent contact. The shroud 212 may also ensure that a shorting arm 240 is moved from the first position to the second position by a mating connector (not shown) before the mating connector contacts the first contact 220 or the second contact 222.

The first contact 220 and the second contact 222 may include shorting surfaces 230 are disposed at other angles 232 than perpendicular (as shown in FIGS. 1A and 1B) to the longitudinal axis 134 of the first contact 220 or the second contact 222. This angle 232 may be chosen to promote contact between shorting surfaces 230 of the first and second contacts 220, 222 and a shorting surface 242 of the shorting arm 240. For example, the angle 232 of the shorting surfaces 230 in some configurations may be about thirty degrees, while in others, the shorting surfaces 230 may be disposed at an angle 232 of about forty-five or sixty degrees. Of course, the angle 232 may be any angle to the longitudinal axis 134.

Additionally, the shorting arm 240 may have shorting surfaces 242 disposed at a reciprocal angle to the shorting surfaces 230 of the first and second contacts 220, 222.

The shorting arm 240 may also include a guide extension 243 that moves in the guide channel 214. The guide extension 243 may prevent the shorting arm 240 from becoming misaligned with a shorting channel 210 of the housing 202 by providing a second point of contact with the housing 202. The guide extension 243 may ensure that the shorting surface 242 of the shorting arm 240 properly contacts the shorting surfaces 230 of the first and second contacts 220, 222.

The guide extension 243 may also help guide the compression and expansion of a spring 250. Specifically, the guide extension 243 may extend through the spring 250 that is disposed to bias the shorting arm 240 toward the first position.

Figure 3:
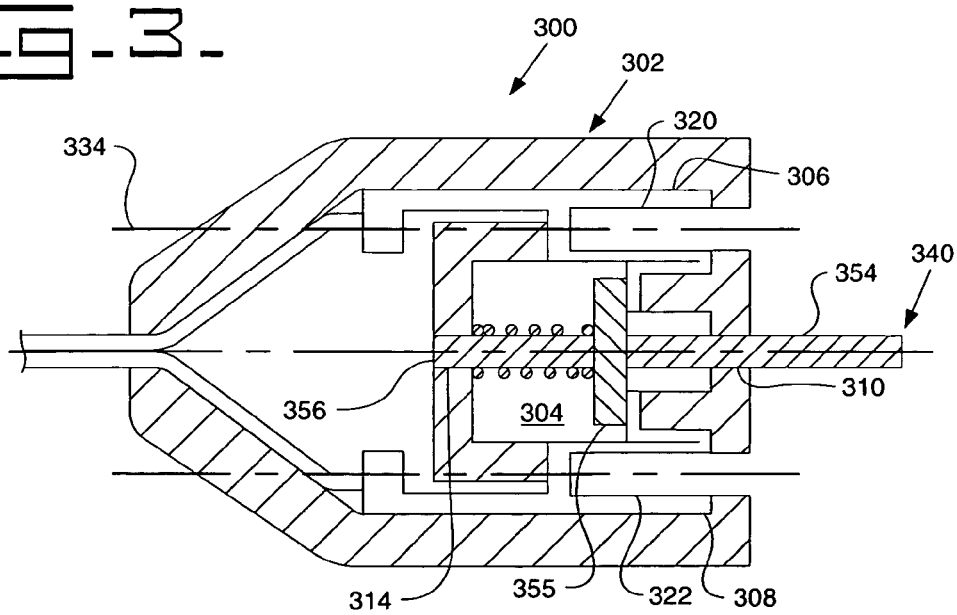
FIG. 3 is a cross sectional view of a female electrical connector.

Referring to FIG. 3, a female electrical connector 300 is provided. Like the male connectors 100 and 200 discussed above, the electrical connector 300 includes a housing 302 having a shorting chamber 304, a first contact channel 306, a second contact channel 308, a shorting channel 310, and a guide channel 314. The electrical connector 300 also includes a first contact 320 and a second contact 322 that are disposed within the respective first and second contact channel 306, 308. The first and second contacts 320, 322 may be configured to receive and engage a first mating contact and a second mating contact of a mating electrical connector (not shown).

A shorting arm 340 may be configured to move within the housing generally parallel to a longitudinal axis 334 of the first contact 320 between a first position as shown where the shorting arm 340 electrically connects the first contact 320 with the second contact 322. Conversely, the shorting arm 340 in the second position is separated from the first and second contacts 320, 322.

In this configuration, the shorting arm 340 may include an engagement protrusion 354, a conducting section 355, and a guidance protrusion 356. The engagement protrusion 354 and the guidance protrusion 356 may be made of a non-conducting material to prevent inadvertent shorting of the first contact 320 with the second contact 322. The conducting section 355 may be made of conducting material such as copper or may only have a conducting surface layer for conducting current between the first and second contacts 320, 322.

INDUSTRIAL APPLICABILITY

The electrical connectors 100, 200, 300 discussed above may be used in many different applications. In one example, the electrical connectors 100, 200, 300 may be used to disconnect an electrical component from a high voltage power source. By shorting the electrical connectors 100, 200, 300, the electrical component attached to one of the electrical connectors 100, 200, 300 may be safely handled since a voltage difference between the contacts may be quickly minimized. A method of using the electrical connectors 100, 200, 300 may include the steps of disconnecting a first contact of the electrical connector from the first mating contact, disconnecting a second contact of the electrical connector from the second mating contact, and moving a shorting arm of the electrical connector generally parallel to the first and second contacts of the electrical connector from the second position toward the first position.

The method may also include the steps of supporting a guide extension of the shorting arm with a guide channel of a housing of the electrical connector and compressing a spring or moving the guide extension with in the guide channel. In this way, the guide extension helps guide compression of the spring and prevents the spring from becoming misaligned during use. Further, the guide extension maintains the alignment of the shorting arm, which enhances reliable operation of the shorting arm over time.

It will be apparent to those skilled in the art that various modifications and variations can be made without departing from the scope or spirit of the invention. For example, this invention may be used with multi-contact, multi-pole applications and connectors. Additionally, other embodiments of the invention will be apparent to those skilled in the art from consideration of the specification and practice of the invention disclosed herein. It is intended that the specification and examples be considered as exemplary only.

LIST OF ELEMENTS

Title: Shorting Connector

File: 06-124

| | |
|---|---|
| 100 | Electrical Connector |
| 102 | Housing |
| 104 | Shorting Chamber Structure |
| 106 | First Contact Channel |
| 108 | Second Contact Channel |
| 110 | Shorting Channel |
| 120 | First Contact |
| 122 | Second Contact |
| 124 | End |
| 126 | Electrical Conductor |
| 128 | another End |
| 130 | Shorting Surface |
| 132 | Angle |
| 134 | Longitudinal Axis |
| 140 | Shorting Arm |
| 142 | Shorting Surface |
| 144 | Angle |
| 146 | Longitudinal Axis |
| 148 | Abutment Surface |
| 150 | Spring |
| 151 | Gap |
| 152 | End (of Shorting Arm) |
| 160 | Mating Connector |
| 162 | Longitudinal Axis (of the Housing) |
| 164 | Securing Structure |
| 166 | Reciprocal Securing |
| 168 | First Mating Contact |
| 170 | Second Mating Contact |
| 200 | Electrical Connector |
| 202 | Housing |
| 210 | Shorting Channel |
| 212 | Shroud |
| 214 | Guide Channel |
| 220 | First Contact |
| 222 | Second Contact |
| 230 | Shorting Surface |
| 232 | Angle |
| 240 | Shorting Arm |
| 242 | Shorting Surface |
| 243 | Guide Extension |
| 250 | Spring |
| 300 | Electrical Connector |
| 302 | Housing |
| 304 | Shorting Chamber |
| 306 | First Contact Channel |
| 308 | Second Contact Channel |
| 310 | Shorting Channel |
| 314 | Guide Channel |

What is claimed is:

1. An electrical connector comprising:

a housing having a first contact channel and a second contact channel;

a first contact having a longitudinal axis disposed within the first contact channel;

a second contact disposed within the second contact channel;

a shorting arm configured to move generally parallel to the longitudinal axis of the first contact between a first position and a second position;

wherein when the shorting arm is in the first position, the shorting arm electrically connects the first contact with the second contact;

wherein when the shorting arm is in the second position, the shorting arm is separated from the first and second contacts; and wherein the shorting arm is configured to move from the first position to the second position before a mating first contact or a mating second contact of a mating electrical connector engages one of the first and second contacts.

2. The electrical connector of claim 1, wherein the housing further comprises a shroud.

3. The electrical connector of claim 1, further comprising a visual indicator for indicating the position of the shorting arm within the electrical connector.

4. The electrical connector of claim 1, wherein the housing comprises a guide channel and the shorting arm includes a guide extension that moves in the guide channel.

5. The electrical connector of claim 4, wherein the guide extension extends through a spring disposed to bias the shorting arm toward the first position.

6. The electrical connector of claim 1, wherein when the shorting arm is in the first position, the shorting arm has an end disposed further from the housing than the ends of the first and second contacts.

7. The electrical connector of claim 1, wherein the first and second contacts and the shorting arm each include a shorting surface extending at an angle to a longitudinal axis of the first and second contacts and the shorting arm, wherein when the shorting arm is in the first position, the shorting surface of the shorting arm abuts the shorting surfaces of the first and second contacts.

8. An electrical connector comprising:

a housing;

a first contact extending from the housing and having an end disposed remotely from the housing;

a second contact extending from the housing and having an end disposed remotely from the housing;

a shorting arm configured to move generally parallel to the first contact between a first position and a second position;

wherein when the shorting arm is in the first position, the shorting arm electrically connects the first contact with the second contact and the shorting arm has an end disposed further from the housing than the ends of the first and second contacts; and wherein when the shorting arm is in the second position, the shorting arm is separated from the first and second contacts.

9. The electrical connector of claim 8, wherein the shorting arm is configured to move from the first position to the second position before a mating first contact or a mating second contact of a mating electrical connector engages one of the first and second contacts.

10. The electrical connector of claim 8, further comprising a visual indicator for indicating the position of the shorting arm within the electrical connector.

11. The electrical connector of claim 8, wherein the housing comprises a guide channel and the shorting arm includes a guide extension that moves in the guide channel.

12. The electrical connector of claim 11, wherein the guide extension extends through a spring disposed to bias the shorting arm toward the first position.

13. The electrical connector of claim 8, wherein the first and second contacts and the shorting arm each include a shorting surface disposed at an angle to a longitudinal axis of the first contact, wherein when the shorting arm is in the first position, the shorting surface of the shorting arm abuts the shorting surface of the first and second contacts.

14. A method of disconnecting an electrical connector from a mating connector having first and second mating contacts, the method comprising:

disconnecting a first contact of the electrical connector from the first mating contact;

disconnecting a second contact of the electrical connector from the second mating contact;

moving a shorting arm of the electrical connector generally parallel to the first and second contacts of the electrical connector from a second position to a first position after the first and second contacts of the electrical connector have been disconnected from the first and second mating contacts, wherein when the shorting arm is in the first position, the shorting arm electrically connects the first contact with the second contact, wherein when the shorting arm is in the second position, the shorting arm is separated from the first and second contacts; and completely separating the electrical connector from the mating connector.

15. The method of claim 14, further comprising the step of disconnecting a retention feature of the electrical connector from a mating retention feature of the mating connector.

16. The method of claim 14, further comprising the step of indicating the position of the shorting arm within the electrical connector by a visual indicator.

17. The method of claim 14, further comprising the step of supporting a guide extension of the shorting arm with a guide channel of a housing of the electrical connector.

18. The method of claim 14, wherein when the shorting arm is in the first position, the shorting arm has an end disposed further from the housing than the ends of the first and second contacts.

19. The method of claim 14, wherein the first and second contacts and the shorting arm each include a shorting surface extending at an angle to a longitudinal axis of the first and second contacts and the shorting arm, wherein when the shorting arm is in the first position, the shorting surface of the shorting arm abuts the shorting surfaces of the first and second contacts.

20. The electrical connector of claim 1, wherein the housing includes a retention feature configured to secure the coupling of the electrical connector with a mating connector.

* * * * *

UNITED STATES PATENT AND TRADEMARK OFFICE

CERTIFICATE OF CORRECTION

PATENT NO. : 7,354,287 B1
APPLICATION NO. : 11/590544
DATED : April 8, 2008
INVENTOR(S) : Hickam It is certified that error appears in the above-identified patent and that said Letters Patent is hereby corrected as shown below:

Please correct the Specification as follows:
Column 6, line 13, after "Shorting Chamber" delete "Structure".

Column 6, line 31, after "Reciprocal Securing" insert -- Structure --.

Signed and Sealed this

Fourth Day of November, 2008

JON W. DUDAS
*Director of the United States Patent and Trademark Office*